US006941661B2

(12) United States Patent
Frazer

(10) Patent No.: US 6,941,661 B2
(45) Date of Patent: Sep. 13, 2005

(54) FOLDING KNIFE

(76) Inventor: Spencer Frazer, 6521 212th St. SW., Seattle, WA (US) 98036

( * ) Notice: Subject to any disclaimer, the term of this patent is extended or adjusted under 35 U.S.C. 154(b) by 274 days.

(21) Appl. No.: 10/217,340

(22) Filed: Aug. 8, 2002

(65) Prior Publication Data

US 2003/0070299 A1 Apr. 17, 2003

Related U.S. Application Data

(60) Provisional application No. 60/353,791, filed on Jan. 31, 2002, and provisional application No. 60/310,941, filed on Aug. 8, 2001.

(51) Int. Cl.[7] ..... B26B 1/04
(52) U.S. Cl. ..... 30/160
(58) Field of Search ..... 30/158–161; 7/118–120

(56) References Cited

U.S. PATENT DOCUMENTS

| | | | | |
|---|---|---|---|---|
| 226,901 | A | 4/1880 | Carter | |
| 551,052 | A | 12/1895 | Shonnard et al. | |
| 600,442 | A * | 3/1898 | Nell | 30/159 |
| 749,230 | A | 1/1904 | Severance | |
| 1,743,022 | A | 1/1930 | Carman | |
| 2,304,601 | A * | 12/1942 | Schrade | 30/159 |
| 4,347,665 | A | 9/1982 | Glesser | |
| 4,404,748 | A | 9/1983 | Wiethoff | |
| 4,451,982 | A | 6/1984 | Collins | |
| 4,719,700 | A | 1/1988 | Taylor, Jr. | |
| 4,811,486 | A | 3/1989 | Cunningham | |
| 4,837,932 | A | 6/1989 | Elsener | |
| 4,896,424 | A | 1/1990 | Walker | |
| 4,974,323 | A | 12/1990 | Cassady | |
| 5,060,379 | A | 10/1991 | Neely | |
| 5,095,624 | A | 3/1992 | Ennis | |
| 5,111,581 | A | 5/1992 | Collins | |
| 5,293,690 | A | 3/1994 | Cassady | |
| 5,331,741 | A | 7/1994 | Taylor, Jr. | |
| 5,400,509 | A | 3/1995 | Collins | |
| 5,437,101 | A | 8/1995 | Collins | |
| D365,266 | S | 12/1995 | Hasegawa | |
| 5,502,895 | A | 4/1996 | Lemaire | |
| 5,537,750 | A | 7/1996 | Seber et al. | |
| 5,692,304 | A | 12/1997 | Campbell | |
| 5,737,841 | A | 4/1998 | McHenry et al. | |
| 5,802,722 | A | 9/1998 | Maxey et al. | |
| 5,815,927 | A | 10/1998 | Collins | |
| 5,964,036 | A | 10/1999 | Centofante | |
| 6,397,476 | B1 | 6/2002 | Onion | |

FOREIGN PATENT DOCUMENTS

| | | |
|---|---|---|
| DE | 1.104.386 | 4/1961 |
| FR | 1.069.862 | 7/1954 |
| FR | 1.248.117 | 10/1960 |

* cited by examiner

*Primary Examiner*—Douglas D Watts
(74) *Attorney, Agent, or Firm*—Christensen O'Connor Johnson Kindness PLLC

(57) ABSTRACT

A biasing system for the blade of a folding knife includes one component or assembly applying a force tending to move the knife blade from a closed position, nested in the handle, to an open position, extending from the handle. A second component or assembly resists opening of the blade, particularly when the blade is in or near the closed position. The resisting force is overcome by the opening force after the blade has been moved through a predetermined angle relative to the handle, so that the blade then opens automatically. A safety can be actuated to block opening and/or closing of the blade. The blade can have a blunt projection upon which a user may press to move the blade through the predetermined opening angle. A clip can be provided for convenient attachment of the folding knife to an object such as a garment.

13 Claims, 15 Drawing Sheets

FOLDING KNIFE

CROSS-REFERENCE TO RELATED APPLICATIONS

This application claims the benefit of U.S. Provisional Application No. 60/310,941, filed Aug. 8, 2001, and U.S. Provisional Application No. 60/353,791, filed Jan. 31, 2002.

FIELD OF THE INVENTION

This invention relates to knives and, more specifically, to a folding knife with a biasing system for the blade to assist in moving the blade toward an open position, and to a knife having a novel clip for convenient attachment to an object such as a garment.

BACKGROUND OF THE INVENTION

Known folding knives have a blade pivoted to a handle. The blade is moveable between an open position in which a sharpened edge of the blade is exposed for use, with the blade projecting from the handle, and a "closed" position in which the sharpened edge of the blade is received in a channel in the handle. Different mechanisms have been provided to move the blade from the closed position to the open position. An example is the system shown in U.S. Pat. No. 5,802,722, which is expressly incorporated by reference herein. See also the "prior art" referred to in U.S. Pat. No. 5,802,722.

SUMMARY OF THE INVENTION

In a first aspect of the present invention, a folding knife is provided with a biasing system for the blade to assist in moving the blade toward an open position.

In a second aspect of the present invention, the biasing system provides a net opening force when the blade is moved through a predetermined angle relative to the handle.

In another aspect of the invention, the biasing system provides a net closing force when the blade is in or near to the closed position.

In another aspect, the biasing system includes one component or assembly applying an opening force, and another component or assembly providing a closing force (particularly when the blade is in or near the closed position), with the closing force being overcome by the opening force after the blade has been moved through a predetermined angle relative to the handle from the closed position toward the open position.

In another aspect, the present invention provides a novel clip for convenient attachment of the folding knife to an object such as a garment.

In another aspect, the present invention provides a safety that can be actuated to prevent opening of the blade from the closed position, and/or unlocking of the blade for movement from the open position toward the closed position.

In another aspect, the present invention provides a novel locking lever having an opening through which a blunt projection from the tang end of the blade projects, so that a user may press on the projection to move the blade from the closed position toward the open position.

These aspects may take many forms, and the foregoing general discussion is not intended to limit the coverage of the claimed construction.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DESCRIPTION OF THE PREFERRED EMBODIMENT

Figure 1:
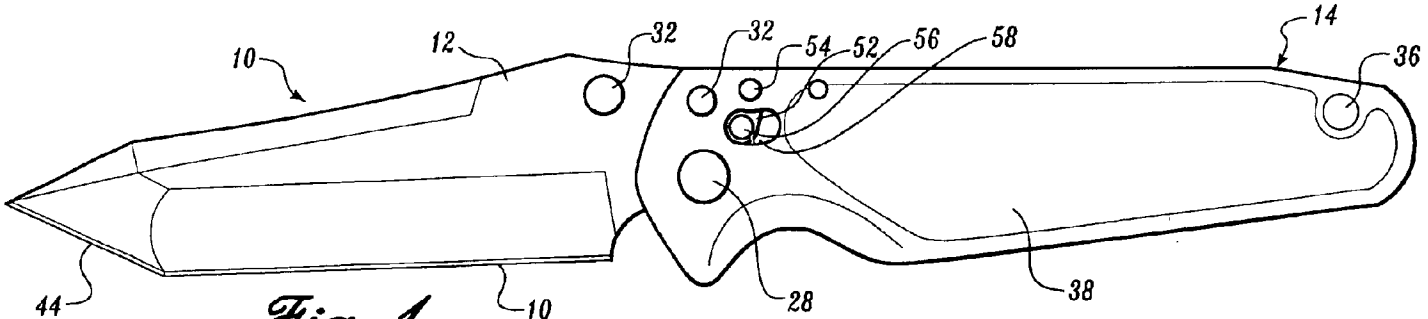
FIG. 1 is a side elevation of a folding knife with opening assist in accordance with the present invention, the blade of the knife being shown in the open position.
Figure 2:
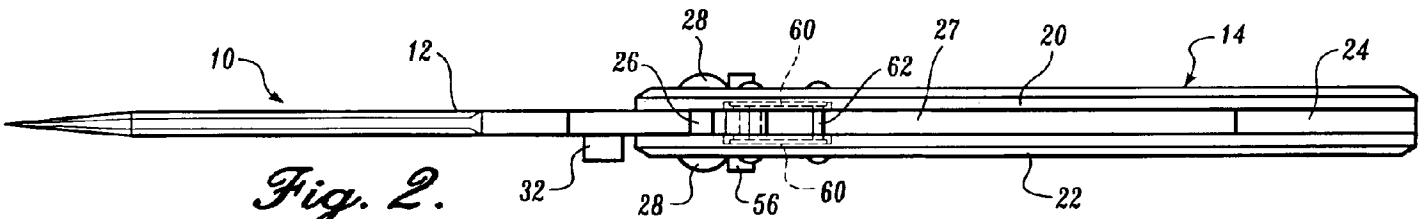
FIG. 2 is a top plan of the knife of FIG. 1.
Figure 3:
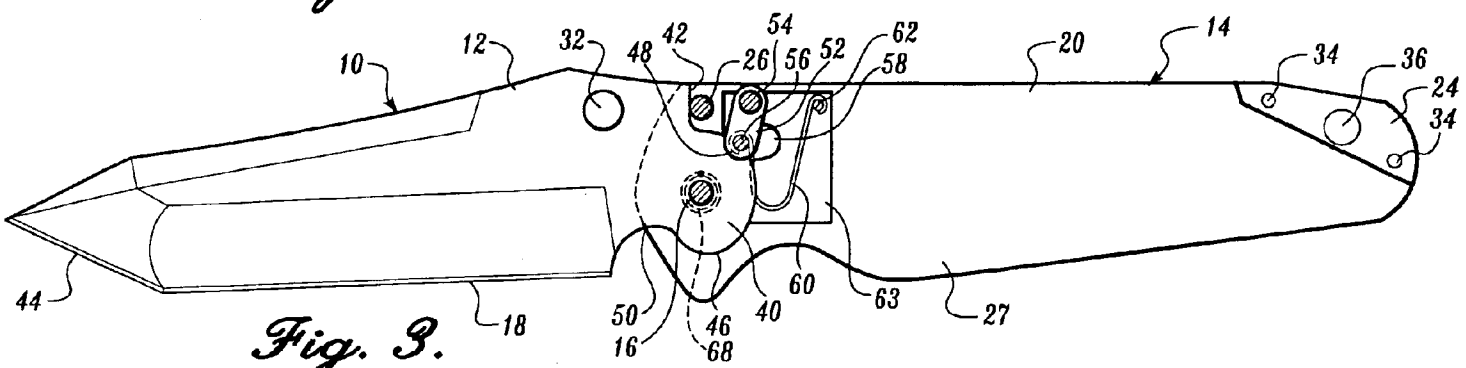
FIG. 3 is a side elevation corresponding to FIG. 1 with parts broken away to reveal internal components.
Figure 4:
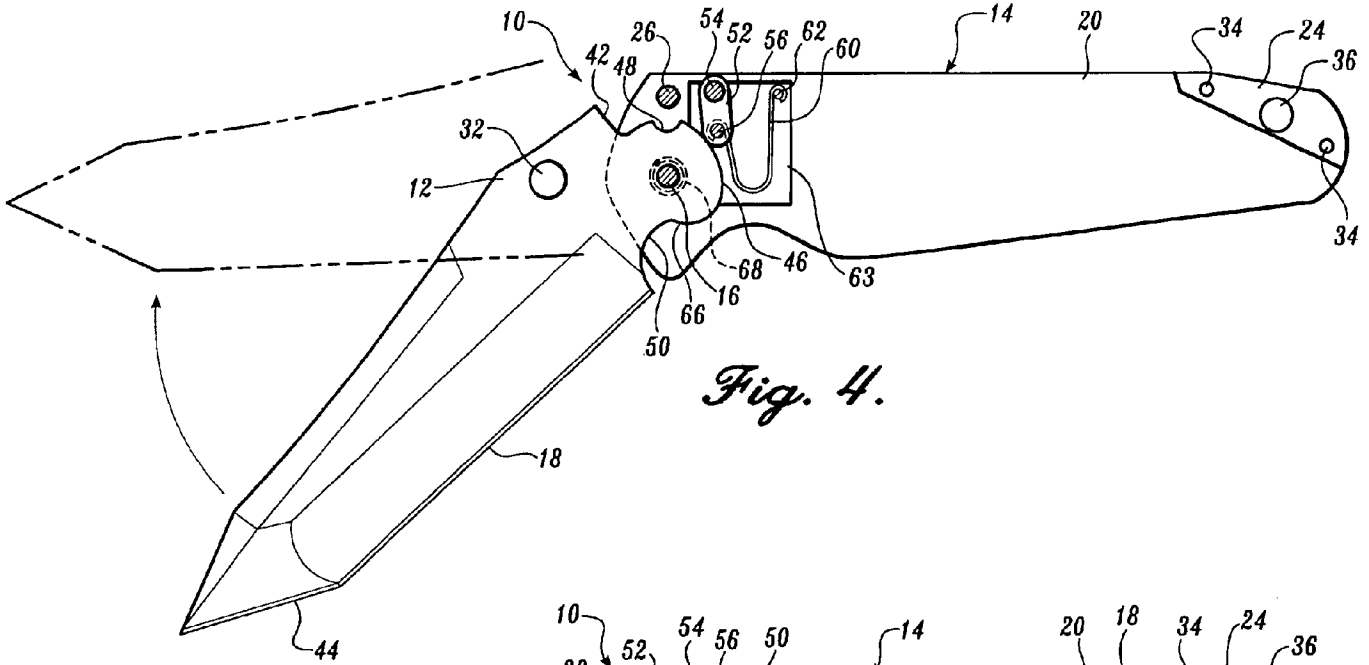
FIGS. 4 and 5 are side elevations corresponding to FIG. 3, with the same parts broken away but with parts in different positions, FIG. 4 showing an intermediate position of the blade and FIG. 5 showing the closed position of the blade.
Figure 5:
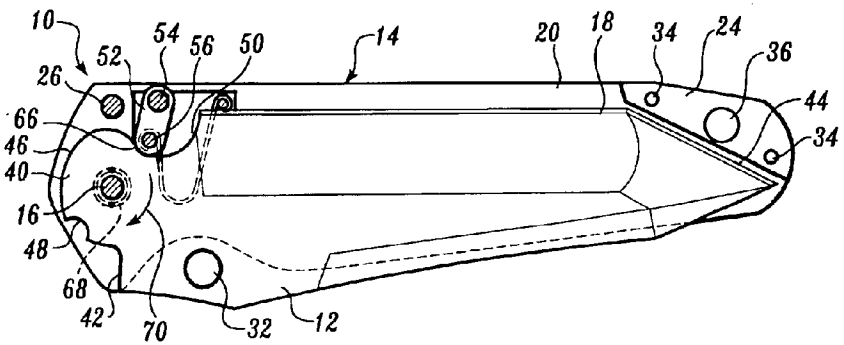

With reference to FIGS. 1–5, a folding knife 10 of the type with which the present invention is concerned has an elongated blade 12 attached to one end portion of a handle 14 by a pivot pin 16 (seen in FIGS. 3–5). As described in more detail below, the blade 12 is swingable relative to the handle between the open or working position shown in FIGS. 1–3, in which the blade extends from the handle with its sharpened edge 18 exposed for use, and a closed position shown in FIG. 5 in which the blade, or at least its sharpened edge portion, is received in the handle. In one aspect of the present invention, an improved mechanism is provided to assist moving the blade to the open position, such as after the blade has been manually moved through a predetermined angle from the closed position.

A typical handle 14 can be formed of several pieces. The handle can include opposite side plates 20, 22 with a rear spacer 24 between them. At the front end of the handle, adjacent to the blade, a stop pin 26 extends between the side plates. The side plates are spaced apart uniformly, forming a groove or channel 27 therebetween of a width slightly greater than the maximum width of the knife blade, for receiving the knife blade in the channel between the handle side plates when the blade is in the closed position.

The blade pivot 16 can include outer portions 28 of a diameter greater than the central blade-carrying portion. The blade swings on the central pin portion between the open position (FIG. 3) and the closed position (FIG. 5). The blade can have a transversely projecting thumb pin or bob 32 near its pivoted end. The pin or bob can be used to manipulate the blade when moving it from the closed position toward the open position, or finger notches or other conventional blade modifications or shapes can be provided for starting to open the knife.

The side plates 20, 22 and spacer 24 can be held together by rivets or screws 34 with a through aperture 36 for attachment of the knife handle to a hook or key chain. The pivot pin 16 and stop pin 26 can be stationarily affixed to the side plates, or one or more of pins 26, 16 can have cooperating threaded parts, as is conventional, which allow the blade to be separated from the handle for replacement or cleaning. The side plates can have contoured portions 38 (FIG. 1) for a comfortable grip. The tang portion 40 of the knife blade, at its butt end adjacent to the knife pivot 16, can have a flattened segment 42 extending generally radially relative to the swinging axis of the blade for engaging the stop pin 26 to limit opening of the knife blade 12 relative to the handle 14. The extent of closing of the knife can be determined by the shape and positioning of the spacer 24 relative to the tapered leading end 44 of the knife blade, as seen in FIG. 5.

In the embodiment illustrated in FIGS. 1–5, the rearwardmost portion of the tang 40 of the blade forms a generally semicircular cam edge 46. Such edge extends from close to the flattened stop portion 42 adjacent to the top of the blade to the bottom portion adjacent to the sharpened edge 18 of the blade. The cam edge 46 has notches or contoured recesses 48 and 50 which cooperate with a mechanical member in the form of an upright locking lever or link 52 as described below.

Link 52 has its upper end portion journaled on a pivot pin 54 extending transversely between the side plates 20, 22, at the side of the handle opposite the opening through which the blade swings. From an upright position, the bottom end of the link can swing fore and aft through a small acute angle relative to vertical. Actuating buttons 56 project transversely from the bottom or swinging end portion of the link 52 through elongated slots 58 (FIG. 1 and FIG. 3) in the handle side plates 20, 22. U-shaped compression springs 60 have their opposite ends connected, respectively, to a cross pin 62 and the actuating buttons 56 at opposite sides of the locking link 52. Such springs 60 bias the link to a forward swung position, toward the tang 40. The springs can be nested in recesses 63 in the inside surfaces of the handle side plates 20, 22 so as not to interfere with swinging of the blade.

With reference to FIG. 3, in the open position of the blade 12, the arcuate bottom end portion of the locking link 52 fits in the notch 48. Preferably, the notch is substantially semicircular, complemental to the shape of the bottom end of the link. In such position, swinging of the knife blade 12 relative to the handle 14 is prevented by engagement of the notched tang against the bottom end portion of the locking link 52. Force applied to the top of the blade in a closing direction is transmitted by way of notch 48 in an upward direction, generally lengthwise of the link toward its pivot pin 54. To release the blade, the user need only press rearward on either of the operating buttons 56, thereby swinging the link to a position in which its bottom end portion is no longer engaged in the notch 48. The blade then can be swung to its closed position, through the position of FIG. 4 to the position of FIG. 5. Releasing the lock by manipulation of one of the buttons is accomplished conveniently and safely because the user's hand typically will lie over the top of the handle 14 and neither the fingers nor hand need to be placed or are encouraged to be placed over the bottom opening of the handle slot 27, in a location where the sharpened edge 18 of the blade would engage them.

In this embodiment, the notch or contoured portion 50 at the opposite side of the tang from notch 48 receives the swinging end portion of the locking link 52 when the knife is in the closed position shown in FIG. 5. However, the recess 50 is shaped such that the swinging end of link 52 engages against an abrupt, more sharply curved portion 66 of the periphery of the blade tang 40. Thus, the blade is positively biased toward the closed position by the link 52.

In addition, mechanism is provided to bias the blade toward the open position. In the embodiment of FIGS. 1–5, this element is a spiral spring 68 encircling the pivot pin 16. One end of the spring is attached to the blade, and the other end of the spring is attached to the adjacent handle, to provide a biasing force in the direction of the arrow 70 of FIG. 5, i.e., toward the open position of the blade.

The biasing force applied by the spiral spring 68 can be approximately constant through the range of motion of the blade relative to the handle. However, any biasing force applied by the link 52 and associated springs 60 is dependent on the contour of the blade tang portion 40 engaged by the link. In the fully closed position, shown in FIG. 5, a substantial moment is created by the engagement of the link 52 against the abrupt tang portion 66, sufficient to overcome the biasing force of the spiral spring 68. However, after the blade has been moved manually toward the open position, the link rides on the central portion 46 of the tang periphery, such as in the position of FIG. 4, where only frictional forces of the tang sliding along the link resist opening of the knife blade by the action of the spiral spring 68. In the preferred embodiment, the forces are balanced such that the blade will be retained in the closed position until it has been moved manually through a predetermined angle (a point of unstable equilibrium), and after movement of the blade beyond that angle, force of the spiral spring 68 is sufficient to move the blade automatically to the open position.

Stated in another way, the action of the link 52 and associated springs 60 provides a "brake force" when the knife is in the closed position, with such force decreasing abruptly or gradually as the knife blade is moved toward the open position, until such time as the biasing force of the spiral spring overcomes the force of the link 52 and associated springs 60.

The result is a knife which need only be moved through a predetermined small angle, such as 15 to 30 degrees, before the biasing force of the spiral spring automatically swings the blade to the fully open position. The net biasing force in the closed position, and the angle of the equilibrium position, are determined by the relative strengths of the two springs and the contouring of the recess 50 adjacent to the sharpened edge 18 of the blade. From the position of FIG. 5, opening movement applied manually to the blade will swing the locking link 52 rearward against the biasing force of the springs 60 until the swinging end of the link has moved sufficiently to ride on the semicircular cam edge portion 46 of the tang 40. See, for example, the position of FIG. 4. To obtain this result, notch 50 must be gradually curved toward the tip of the blade, forming a recess within which the locking link may swing as the blade is opened.

Figure 6:
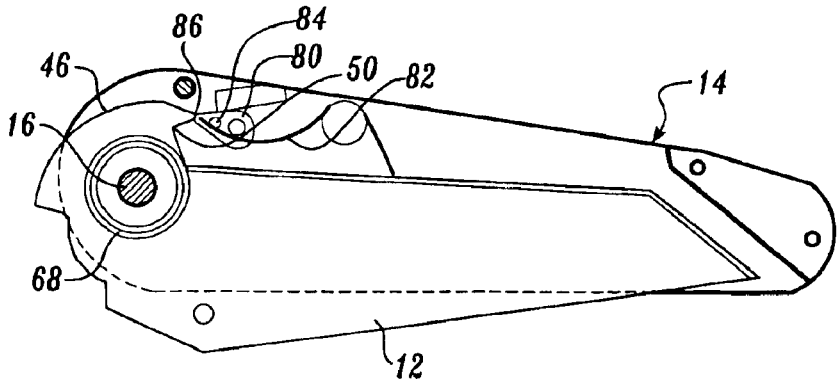
FIG. 6 is a somewhat diagrammatic side elevation of a second embodiment of a folding knife with opening assist in accordance with the present invention, with parts broken away to reveal internal components of the knife, showing the closed position of the blade.
Figure 7:
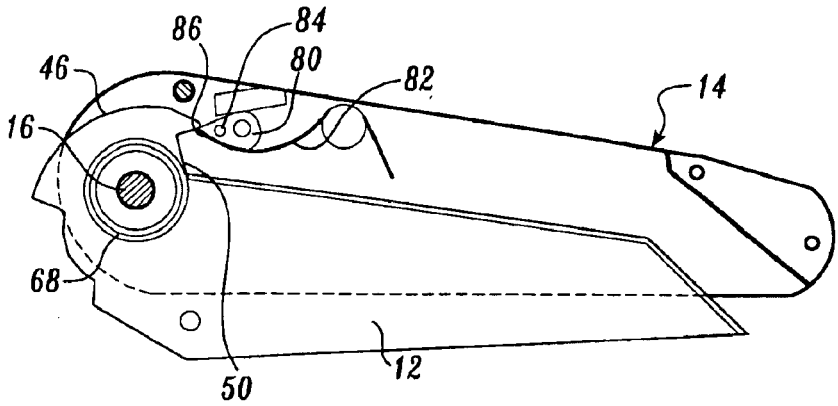
FIG. 7 is a side elevation corresponding to FIG. 6 but with the blade moved toward the open position.
Figure 8:
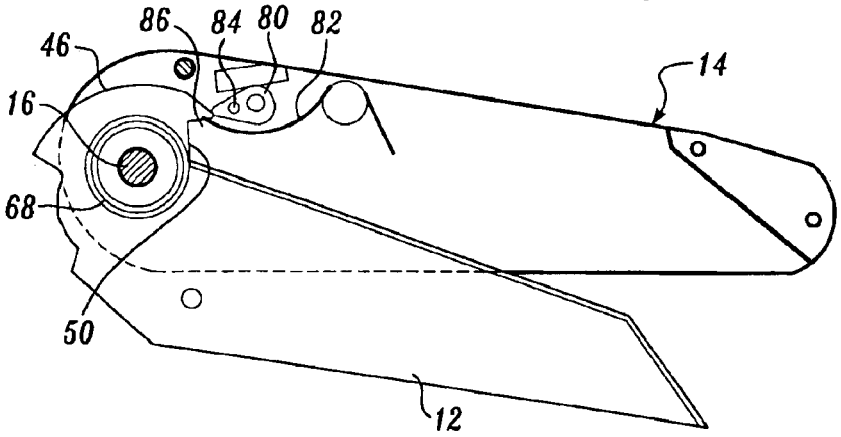
FIG. 8 is a side elevation corresponding to FIGS. 6 and 7 but with the blade moved farther toward the open position.
Figure 9:
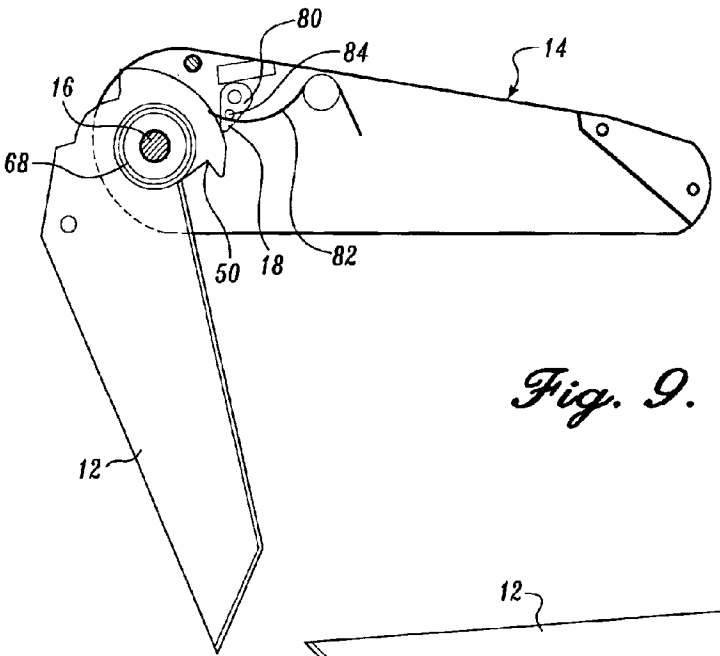
FIG. 9 is a side elevation corresponding to FIGS. 6–8 but with the blade moved farther toward the open position.
Figure 10:
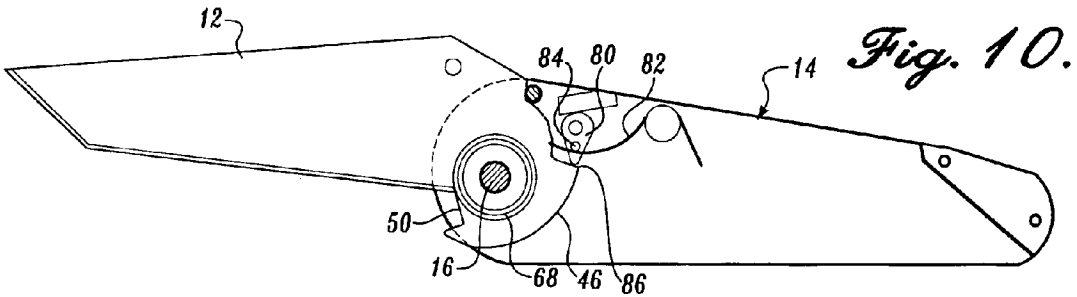
FIG. 10 is a side elevation corresponding to FIGS. 6–9 but with the blade in the open position.

Similar to the embodiment of FIGS. 1–5, the embodiment of the invention shown in FIGS. 6–10 includes a blade 12 pivotally mounted between side plates of a handle 14 by a pivot pin 16. A force biasing the blade toward the open position is supplied by a spiral spring 68. A mechanical member in the form of a brake lever 80 is biased to the position shown in FIG. 6 by engagement of a leaf spring 82 against a pin 84 projecting transversely from the brake lever. The spring and pin are offset from the plane of the blade, including its tang portion. However, the brake lever has a projecting tip portion 86 which, in the closed position of the blade shown in FIG. 6, engages against an undercut side of a contoured notch 50 formed in the tang end portion of the blade. In the position of FIG. 6, as well as the partially opened positions of FIGS. 7 and 8, the brake lever, in combination with its biasing leaf spring, supplies a force in the closing direction sufficient to overcome the opening force supplied by the spiral spring. However, after the blade has been moved toward the open position through a predetermined angle, the notched portion of the tang moves past the tip of the brake lever so that the brake lever simply rides along the semicircular portion 46 of the tang, such as in the position of FIG. 9. In this position, the biasing force of the spiral spring overcomes any braking action of the brake lever, and the knife blade is automatically swung to the open position shown in FIG. 10.

Another aspect of the embodiment of FIGS. 6–10 is that the force applied to the brake lever differs as the lever swings because the pin 84 rides along the length of the leaf spring 82. A greater force is applied with the blade closed than with the blade partially opened because the effective length of the leaf spring decreases as the lever swings from the position shown in FIG. 6 to the position shown in FIG. 8, for example.

Figure 11:
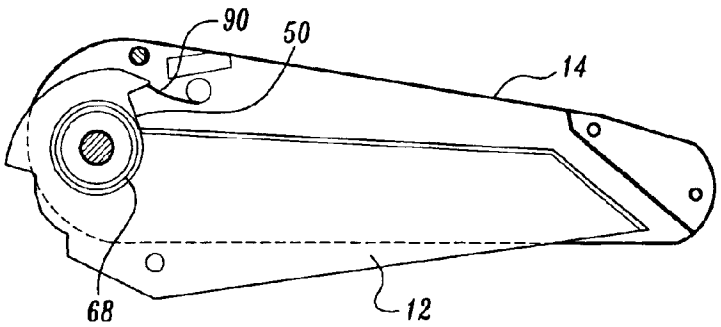
FIG. 11 is a somewhat diagrammatic side elevation of a third embodiment of a folding knife with opening assist in accordance with the present invention, with parts broken away to reveal internal components of the knife, and with blade of the folding knife in the closed position.
Figure 12:
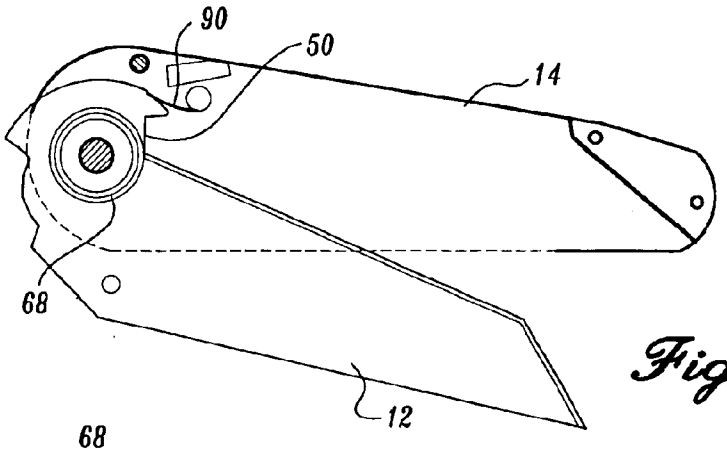
FIG. 12 is a side elevation corresponding to FIG. 11 but with the blade moved part way toward the open position.
Figure 13:
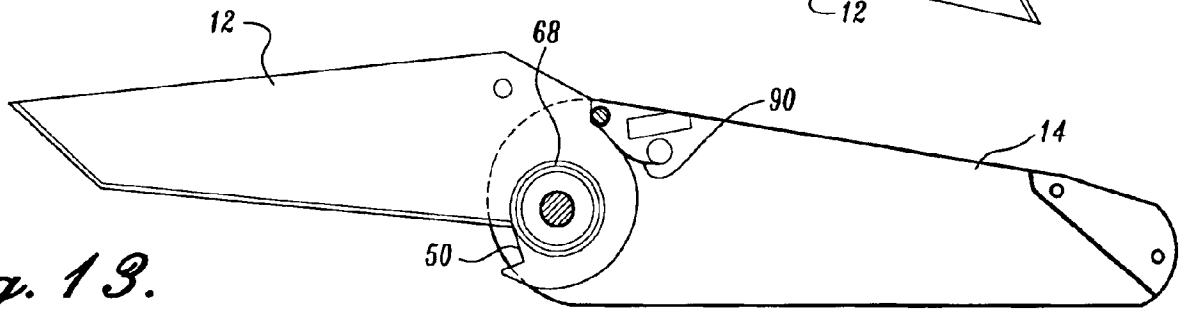
FIG. 13 is a side elevation corresponding to FIGS. 11 and 12 but with the blade moved to the open position.
Figure 14:
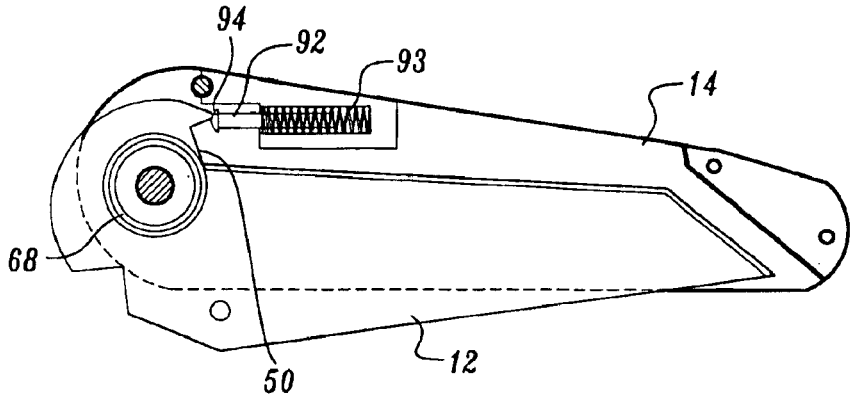
FIG. 14 is a somewhat diagrammatic side elevation of a fourth embodiment of a folding knife with opening assist in accordance with the present invention, with parts broken away to reveal internal components of the knife, and with the blade of the folding knife in the closed position.

In the embodiment of FIGS. 11–13, rather than providing a brake assembly, including a lever and spring, the braking force is supplied only by a leaf spring 90. In the closed position (FIG. 11) the tip of the leaf spring engages against the notched portion 50 of the blade tang. When the blade is partially opened, such as to the position of FIG. 12, the tip of the leaf spring is moved past the notched portion of the tang, and the force of the spiral spring 68 will automatically swing the blade to the open position.

Figure 15:
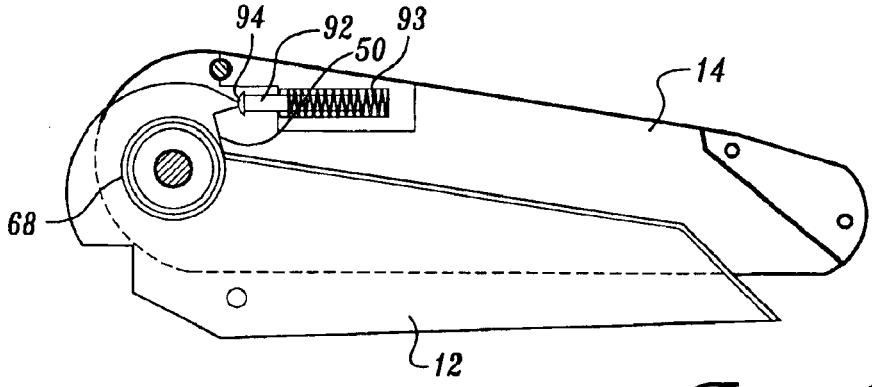
FIG. 15 is a side elevation corresponding to FIG. 14 but with the blade moved toward the open position.
Figure 16:
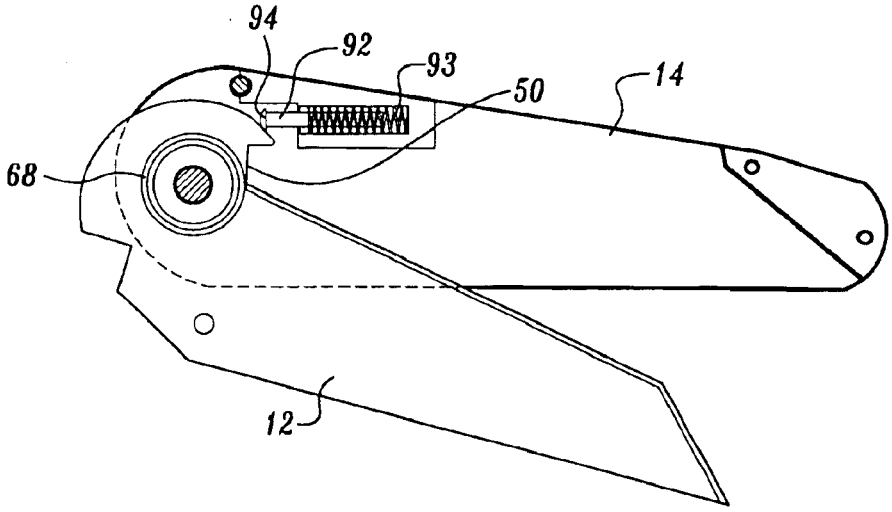
FIG. 16 is a side elevation corresponding to FIGS. 14 and 15 but with the blade moved farther toward the open position.
Figure 17:
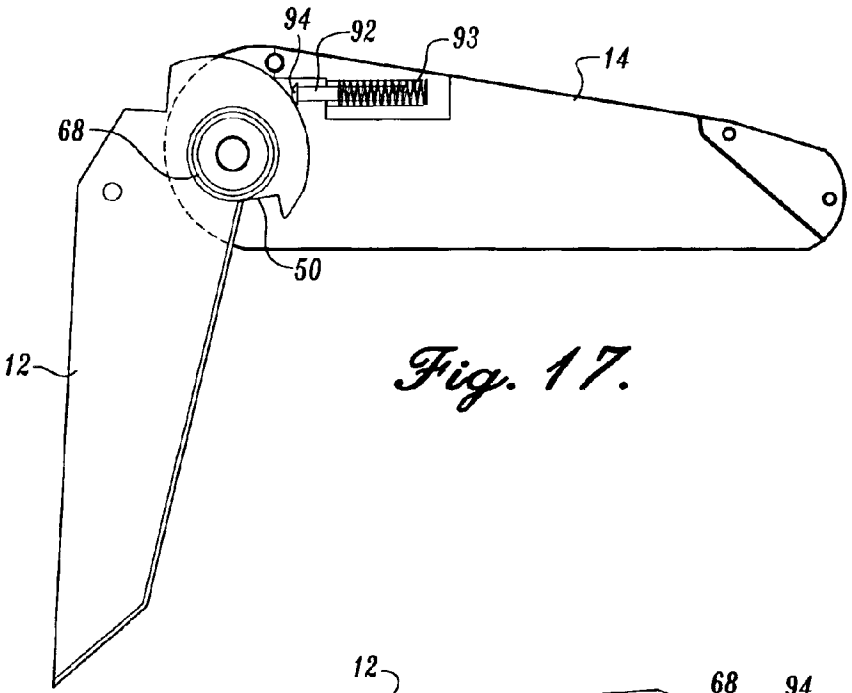
FIG. 17 is a side elevation corresponding to FIGS. 14–16 but with the blade moved farther toward the open position.
Figure 18:
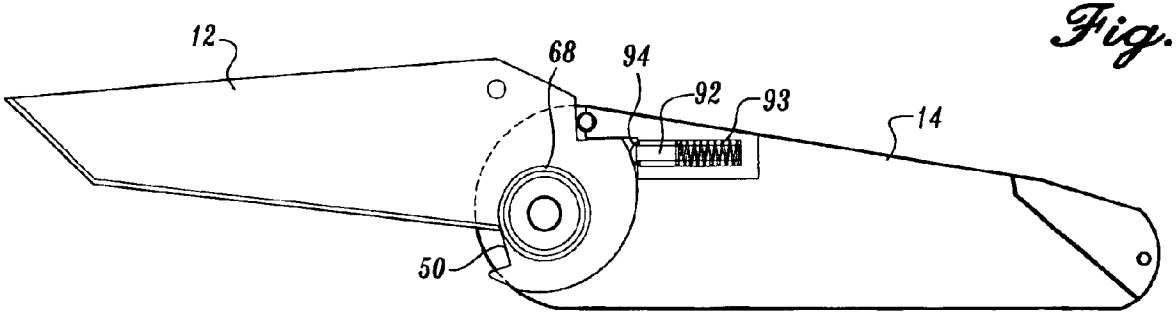
FIG. 18 is a side corresponding to FIGS. 14–17 but with the blade in the open position.

In the embodiment of FIGS. 14–18, the brake force is supplied by a mechanical member in the form of a spring-loaded plunger 92 mounted between the side plates of the handle 14 and biased by a helical compression spring 93. The plunger has a rounded tip 94 which, in the closed position of the blade shown in FIG. 14, supplies a substantial force resisting opening movement of the blade 12 by engagement against a side of the notch 50. When the blade is partially opened, such as is shown in FIG. 15, the notched portion of the tang of the blade moves into alignment with the spring-loaded plunger, which determines the equilibrium position. As the blade is swung more toward the open position, such as the position shown in FIG. 16, the brake force supplied by the spring-loaded plunger is not sufficient to overcome the biasing force of the spiral spring 68, and the blade is automatically swung to the open position, through the position of FIG. 17 to the position of FIG. 18.

Figure 19:
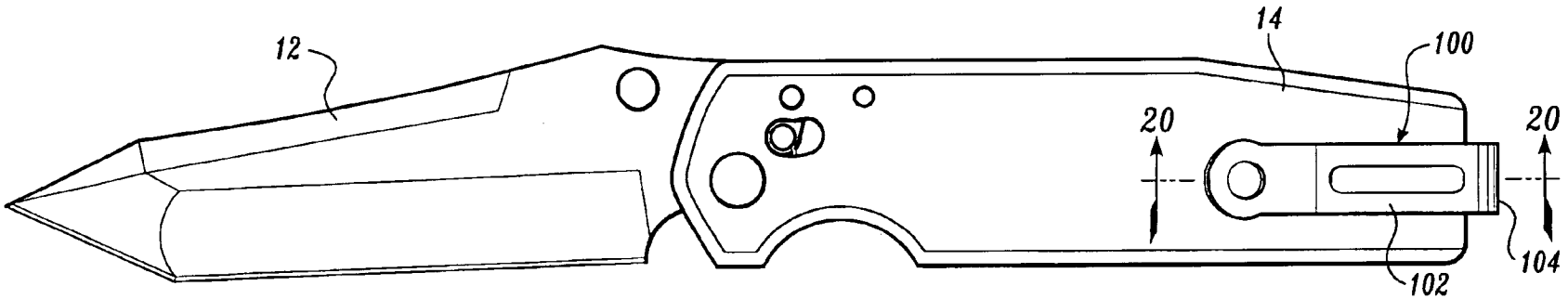
FIG. 19 is a side elevation of a knife having a attachment clip in accordance with the present invention.
Figure 20:
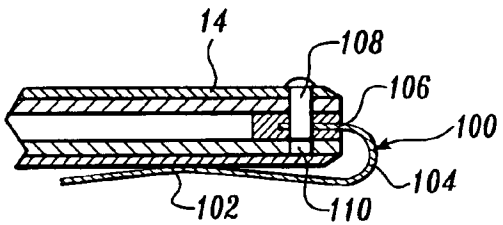
FIG. 20 is a fragmentary section thereof taken along line 20—20 of FIG. 19.

With reference to FIGS. 19 and 20, it can be convenient to provide a spring clip 100 on the end of the handle 14 remote from the blade pivot, for attaching the knife to an object, such as a belt, bag, pocket, visor, and so on. The clip illustrated includes a long spring arm 102 extending along one of the handle side plates, a return bent portion 104, and an opposite end portion 106 fittable into a slot in the rear end of the handle. For example, the slot may be formed in the spacer between the knife side plates. The end portion 106 of the clip received in the slot has a hole for a threaded fastener 108 that can be inserted through a bore 110 aligned with the slot. One advantage of the construction illustrated is that, with the fastener removed, the clip can be detached from the handle and rotated into a position for use with the opposite side. Thus, the orientation of the clip can be customized based on the preference of the user.

Figure 21:
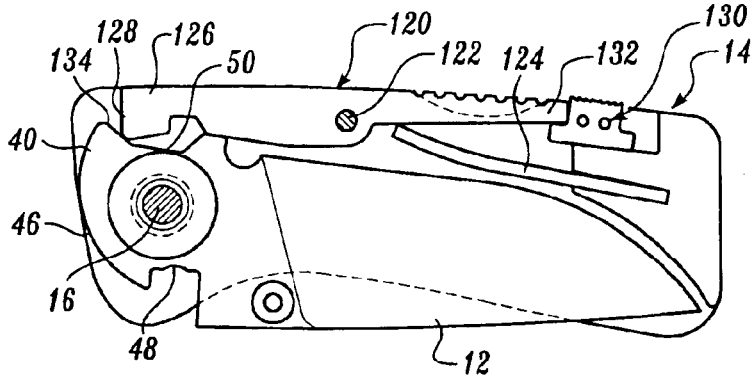
FIG. 21 is a somewhat diagrammatic side elevation of another embodiment of a folding knife with opening assist in accordance with the present invention, with parts broken away to reveal internal components of the knife, and with the blade of the folding knife in the closed position.
Figure 22:
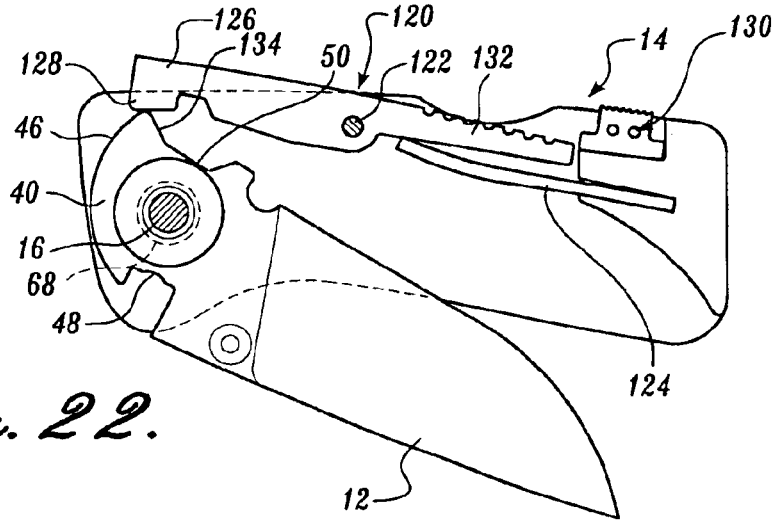
FIG. 22 is a side elevation corresponding to FIG. 21 but with the blade moved toward the open position.
Figure 23:
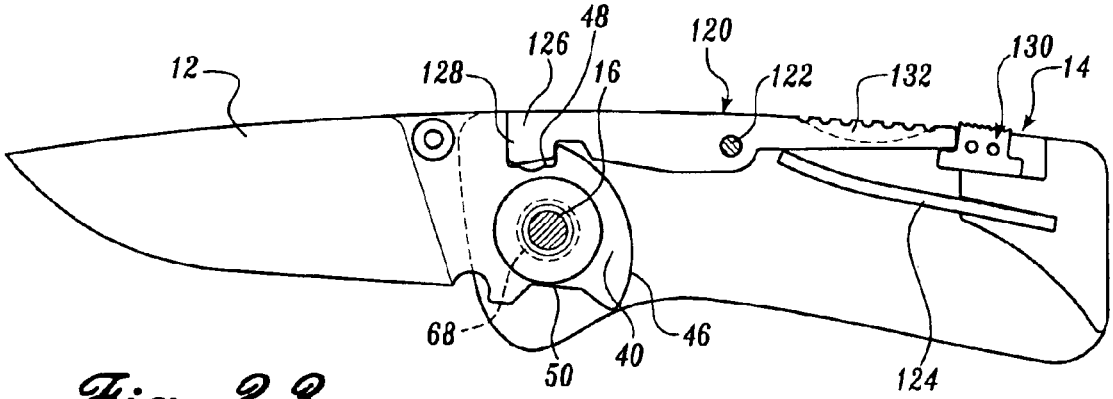
FIG. 23 is a side elevation corresponding to FIGS. 21 and 22 but with the blade in the open position.

In the embodiment of FIGS. 21–23 the blade 12 rotates about the axis of the pivot 16 relative to a handle 14 between the closed position shown in FIG. 21 and the open position shown in FIG. 23. FIG. 22 shows an intermediate position. A mechanical member in the form of a biasing and locking lever 120 is received between opposite sides of the handle and is mounted for rotation about a pivot 122. A leaf spring 124 biases the lever 120 such that a leading end portion 126 of the lever is urged downward toward the tang 40 of the blade. The leading portion 126 has a hooked end 128 that fits within a locking notch 48 in the tang when the blade is in the open position, as seen in FIG. 23. A sliding safety mechanism 130 (described in more detail below with reference to FIG. 30, for example) fits against a trailing portion 132 of the lever and must be moved rearward to free the lever such that it can be rotated by manually pressing downward on trailing portion 132 to lift the hooked end 128 from the locking notch 48, whereupon the blade can be moved toward the closed position against the biasing force of the spiral spring 68. Similarly, mechanism 130 can be moved when the blade is closed. FIG. 21 shows the safety in the blade-locking position which prevents opening movement of the blade. From that position the safety can be manually moved rearward to permit swinging of the lever 120 and opening of the blade.

In the closed position of the blade 12, the hooked end 128 of lever 120 fits within a contoured notch 50 of the tang 40. The nose of the hooked end 128 is biased into engagement against an inclined portion 134 of the notch. The biasing force of the spring 124 is sufficient that with the blade in the closed position, the hooked end 128 applies a "braking force" sufficient to overcome the opening force of the spring 68. However, the blade can be moved manually from the closed position of FIG. 21, through the partially open position of FIG. 22, with the effect of wedging the leading portion 126 of lever 120 upward and outward as the blade rotates. Eventually, the blade reaches a position where the hooked end 128 of lever 120 rides on the generally semicircular portion 46 of the tang 40. At this point, the lever 120 does not apply sufficient braking force to overcome the opening force of the spiral spring 68, and the blade will automatically swing to the open position shown in FIG. 23.

Figure 24:
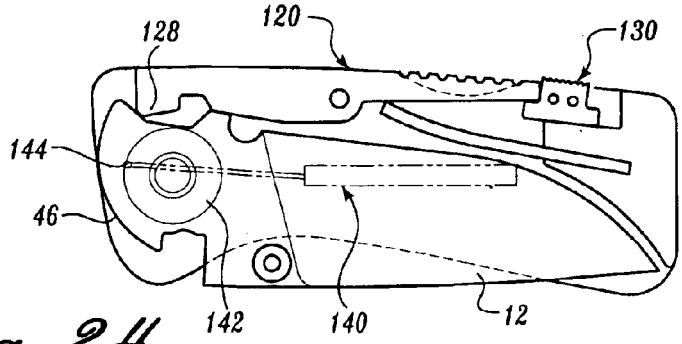
FIG. 24 is a somewhat diagrammatic side elevation of another embodiment of a folding knife with opening assist in accordance with the present invention, with parts broken away to reveal internal components of the knife, and with the blade of the folding knife in the closed position.
Figure 25:
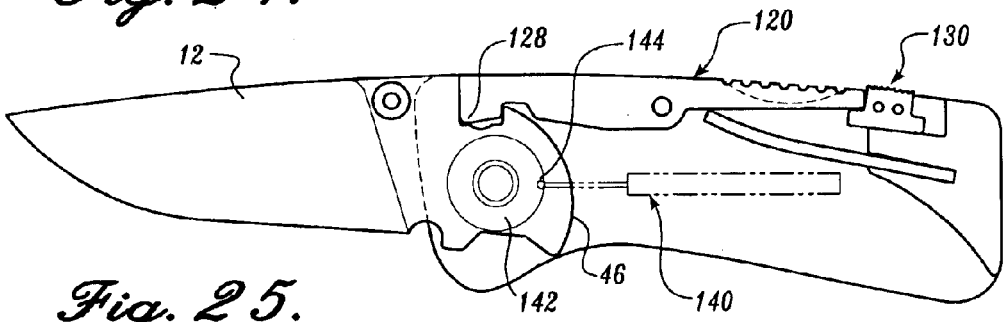
FIG. 25 is a side elevation corresponding to FIG. 24 but with the blade in the open position.

The embodiment of FIGS. 24 and 25 is the same as the embodiment of FIGS. 21 and 23, except for the elements applying the constant opening force to the blade 12. In the embodiment of FIGS. 24 and 25, a tension spring assembly 140 is used. The, tension spring assembly is shown diagrammatically, and connects to a hub portion 142 of the blade. The net moment applied by the tension spring assembly depends on the angular position of the blade. For example, in the closed position of the blade illustrated in FIG. 24, the rotational force applied by the tension spring assembly is quite small, whereas the net opening force applied increases as the blade is swung toward the open position and the connection point 144 of the tension assembly moves. As in the other embodiments, the braking force applied when the blade is closed is sufficient to overcome the opening force, but when the blade has been swung through a predetermined angle toward the open position, such as when the hooked end 128 of the lever 120 rides on the semicircular portion 46 of the blade tang, the opening force is greater than the braking force and the blade will be swung automatically to the open position.

Figure 26:
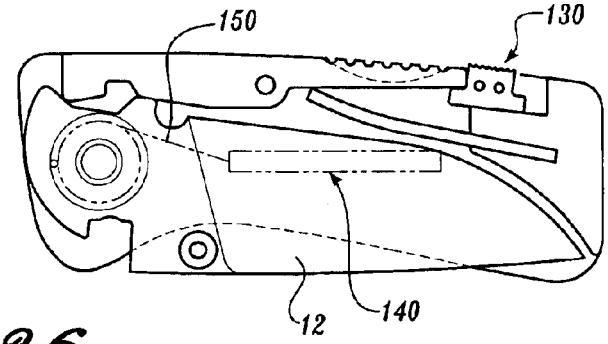
FIG. 26 is a somewhat diagrammatic side elevation of another embodiment of a folding knife with opening assist in accordance with the present invention, with parts broken away to reveal internal components of the knife, and with the blade in the closed position.
Figure 27:
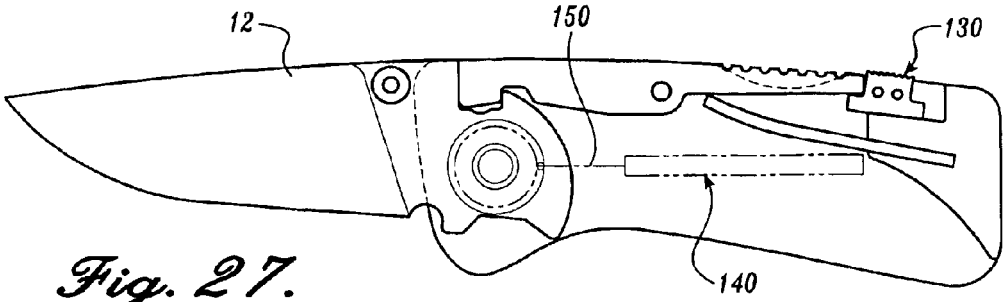
FIG. 27 is a side elevation corresponding to FIG. 26 with the blade in the open position.
Figure 28:
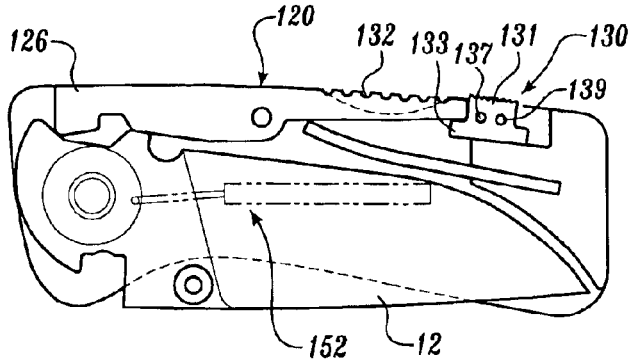
FIG. 28 is a somewhat diagrammatic side elevation of another embodiment of a folding knife with opening assist in accordance with the present invention, with parts broken away to reveal internal components of the knife, with the blade of the folding knife in the closed position.
Figure 29:
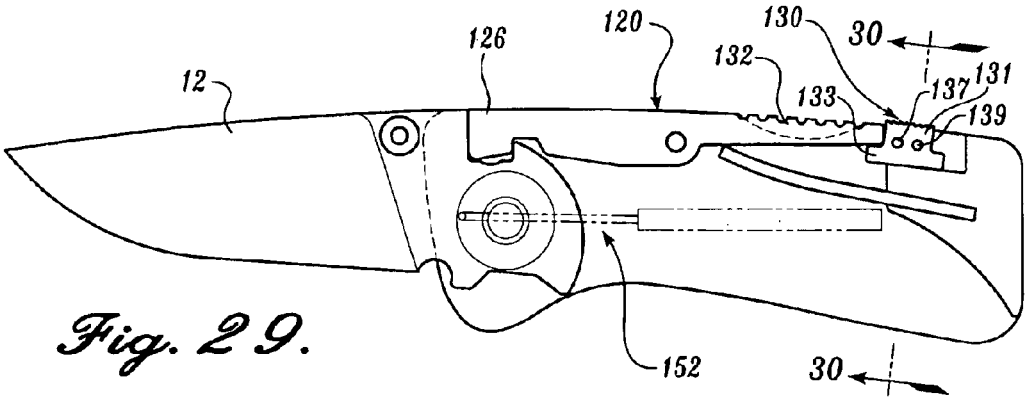
FIG. 29 is a side elevation corresponding to FIG. 27 but with the blade in the open position.

Similarly, in the embodiment of FIGS. 26 and 27 a modified form of tension spring assembly 140 is used, including a flexible wire segment 150 which, in the closed position of the blade 12 (FIG. 26), extends around the hub of the blade (like a pulley). The spring is located within a housing for pulling on the wire in a direction tending to rotate the blade toward the open position. FIGS. 28 and 29 show a similar embodiment using a compression spring assembly 152. In all cases, the member, component or assembly biasing the blade open does not exert a force sufficient to overcome a braking force applied by another member, component or assembly when the blade is in the closed position, but the braking force is insufficient to overcome the opening force after the blade has been moved manually through a predetermined angle from the closed position toward the open position.

Figure 30:
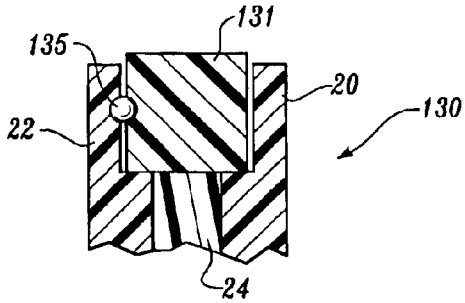
FIG. 30 is an enlarged fragmentary section along line 30—30 of FIG. 29.

Each of the embodiments of FIGS. 21–23, FIGS. 24–25, FIGS. 26–27 and FIGS. 28–29 have the safety mechanism 130 which can be used to selectively block movement of a lever 120 such that inadvertent movement of the blade from the closed position or from the open position is prevented. For example, if a knife having assisted opening is carried in a pocket in the closed position, the thumb bob could conceivably catch or snag as the knife is removed. This could result in partial opening of the blade to the point where the opening mechanism takes control and swings the blade to the fully open position unintentionally. With reference to FIG. 30, the safety mechanism 130 includes a block 131 slideable fore and aft along a notch or shoulder formed in the handle, such as in the spacer 24 and the handle side plates 20, 22. As seen in FIGS. 28 and 29, for example, the leading end of the block 131 forms a projection 133 that fits under the trailing end portion 132 of the lever 120, blocking swinging movement of the lever in a direction to lift the leading end portion 126 away from the tang of the blade 12. The lever can be released by manually sliding the safety block rearward. Preferably a detent mechanism is provided to hold the block in its forward or rearward slid position. With reference to FIG. 30, the detent mechanism can include a ball 135 fitted in a socket of one of the handle side plates. The ball engages a depression 137 or 139 in a side of the block 131 depending on whether the block is in its forward (safety on) or rearward (safety off) position.

The embodiment shown in FIGS. 31–35 has many of the features of the embodiment of FIGS. 21–23. Blade 12 rotates relative to a handle 14 about the axis of a pivot pin 16. A mechanical member in the form of a locking lever 120 extends along the top of the handle and swings about a pivot 122. A leaf spring 124 carried by the handle biases the lever 120 such that the leading end portion 126 is biased downward toward the tang 40 of the blade. The safety mechanism 130 can be actuated to block swinging movement of the lock lever 120. In the closed position of the blade (FIG. 31), the forward portion 126 of the lock lever fits in a contoured notch 50 of the tang such that, with the safety 130 released, the blade can be manually swung toward the open position, wedging the leading end 126 of lever 120 upward against the biasing force of the leaf spring 124. When the blade has been swung through a predetermined angle, slightly beyond the position shown in FIG. 32, the biasing force of an opening spring, depicted diagrammatically as a spiral spring 68, is sufficient to overcome any braking force achieved by the assembly of spring 124 and lever 120. From the predetermined angular position, the blade 12 is automatically swung open to the position of FIG. 33 by the action of the opening spring 68. Other mechanisms for biasing the blade to the open position can be used.

Figure 31:
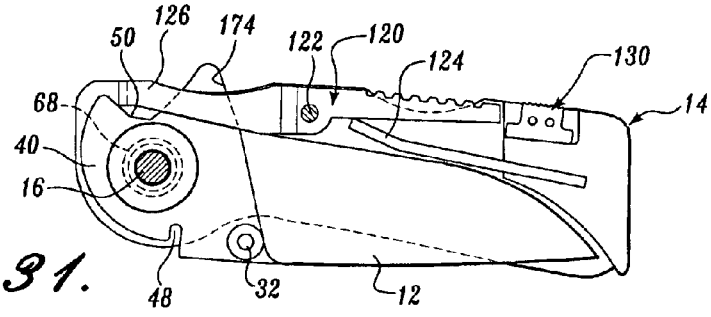
FIG. 31 is a somewhat diagrammatic side elevation of another embodiment of a folding knife with opening assist in accordance with the present invention, with parts broken away to reveal internal components of the knife, and with the blade in the closed position.
Figure 32:
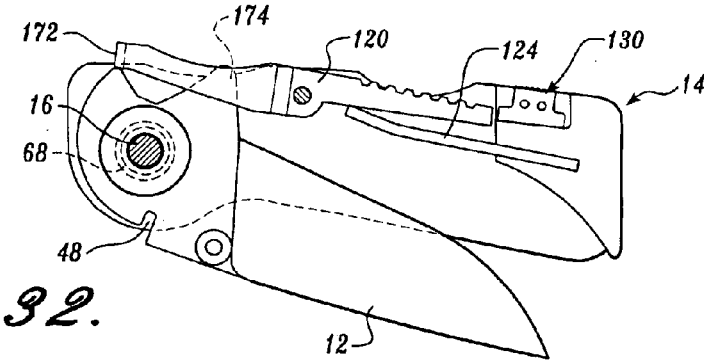
FIG. 32 is a side elevation corresponding to FIG. 31 but with the blade moved toward the open position.
Figure 33:
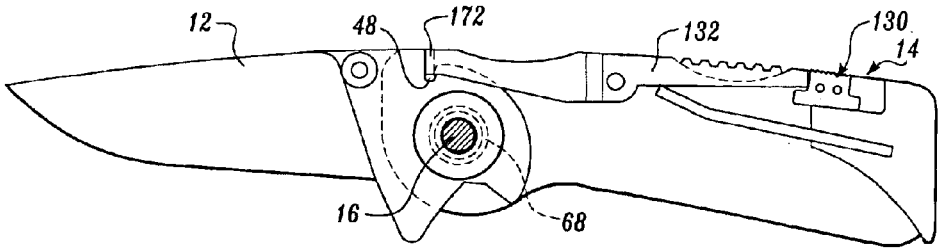
FIG. 33 is a side elevation corresponding to FIGS. 31 and 32 but with the blade in the open position.
Figure 34:
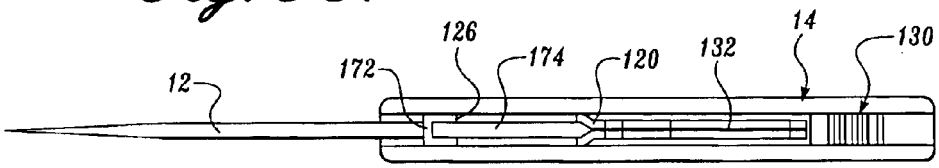
FIG. 34 is a somewhat diagrammatic top plan of the knife of FIGS. 31–33 with the blade in the open position.
Figure 35:
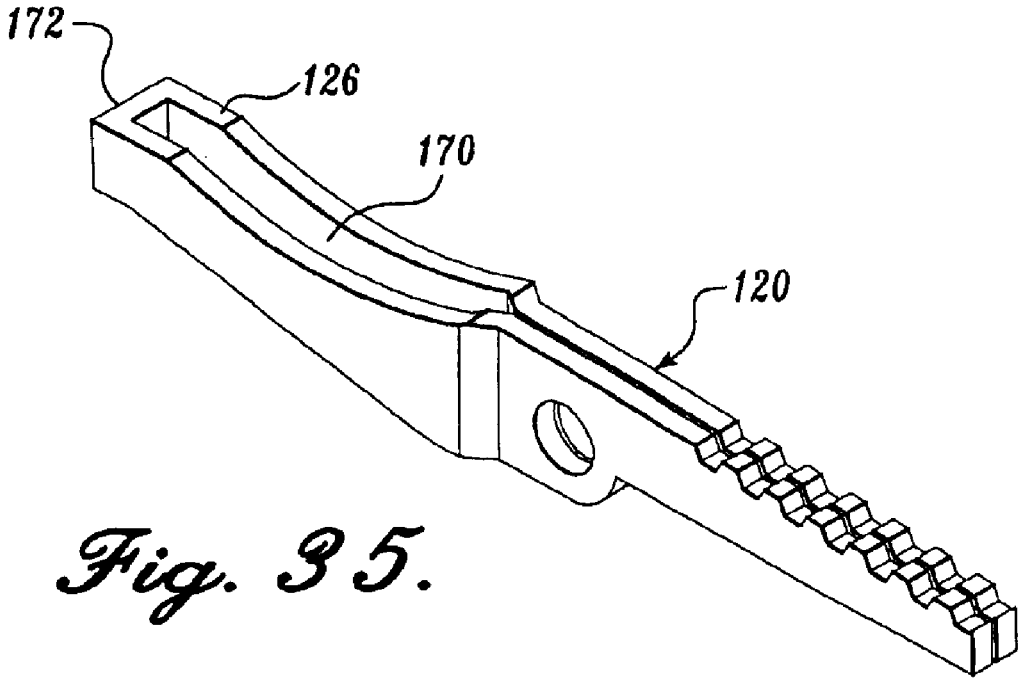
FIG. 35 is a top perspective of a component of the knife of FIGS. 31–34.

As best seen in FIGS. 34 and 35, the locking lever 120 is formed with a central opening 170 along the leading end portion 126. The leading tip 172 of the lever 120 spans between opposite sides of the opening 170. The width of the opening 170 is sufficient for receiving a projecting portion 174 of the blade tang, generally opposite the thumb bob 32, as seen in FIG. 31. In the closed position of the knife, the projecting portion 174 of the tang extends through the central opening of the lever 120. Preferably the projection 174 is blunt, such that a user may press downward on it, thereby causing the blade to swing from the closed position toward the open position, as seen in FIG. 32. At this position the closing force of the brake mechanism is overcome and the blade automatically swings to the open position shown in FIG. 33 due to the biasing force of the opening spring 68. The end portion 172 of the lever fits into the blade locking slot 48 such that the blade is held open until, with the safety released, the trailing end portion 132 of the lever 120 can be depressed to release the blade for manual swinging back to the closed position, against the biasing force of the opening spring 68.

In the embodiment of FIGS. 36–39, a different type of mechanical blade braking and blade locking member is used. As in the other embodiments, a blade 12 is pivotally mounted on a handle 14 by a pivot 16. The tang 40 of the blade has a notch 48 for reception of the nose 180 of a plunger mechanism 182 when the blade is in the open position. The plunger mechanism 182 is biased forward, toward the tang of the blade, by a helical compression spring 184. The plunger can be fitted in an elongated channel formed in the handle 14, in the same plane as the blade 12 and its tang 40. An operating button 186 (FIG. 36) connects to the plunger 182, such as by an internal pin 188 (FIG. 37), such that the plunger can be refracted to release the blade by manipulation of the button 186 from the exterior of the handle 14.

Figure 36:
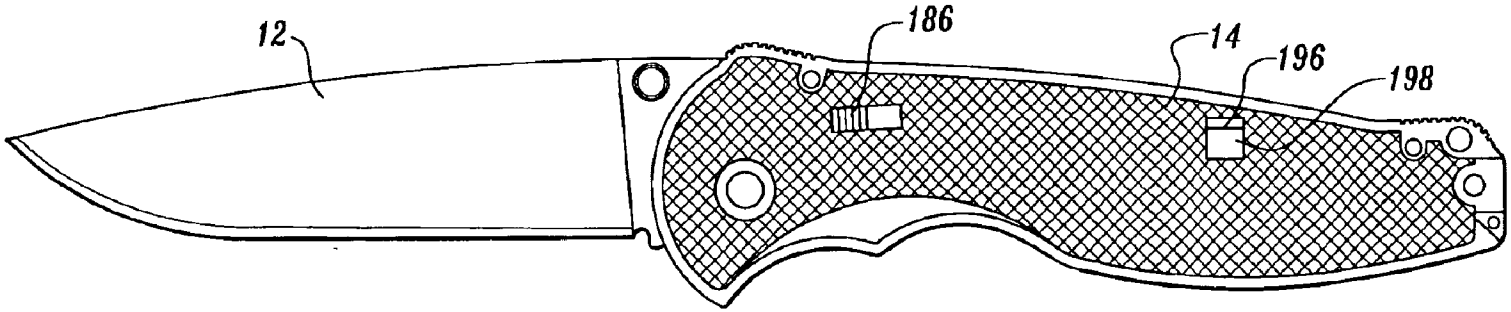
FIG. 36 is a somewhat diagrammatic side elevation of another embodiment of a folding knife with opening assist in accordance with the present invention, the blade of the knife being shown in the open position.
Figure 37:
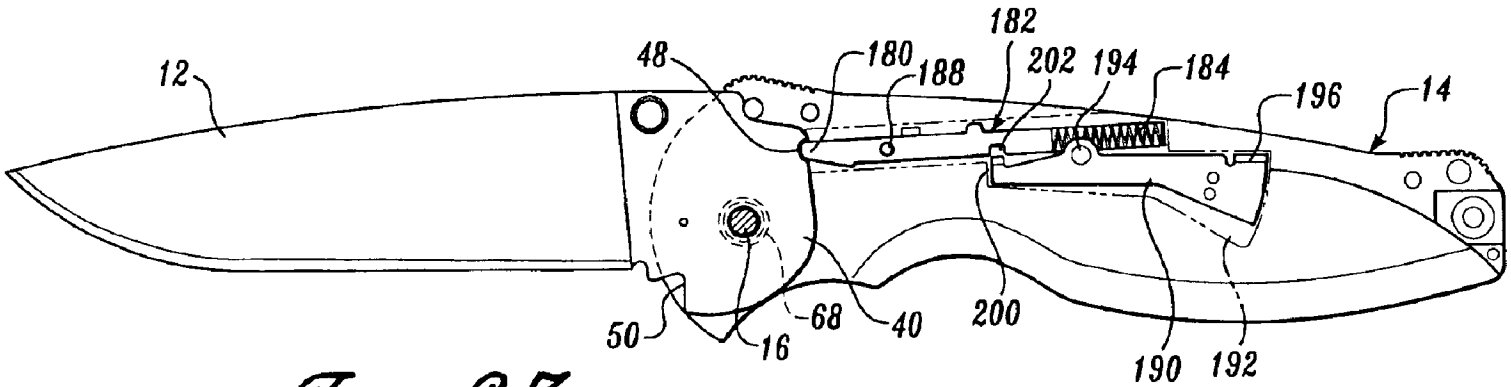
FIG. 37 is a somewhat diagrammatic side elevation corresponding to FIG. 36, with some parts broken away to reveal internal components.
Figure 38:
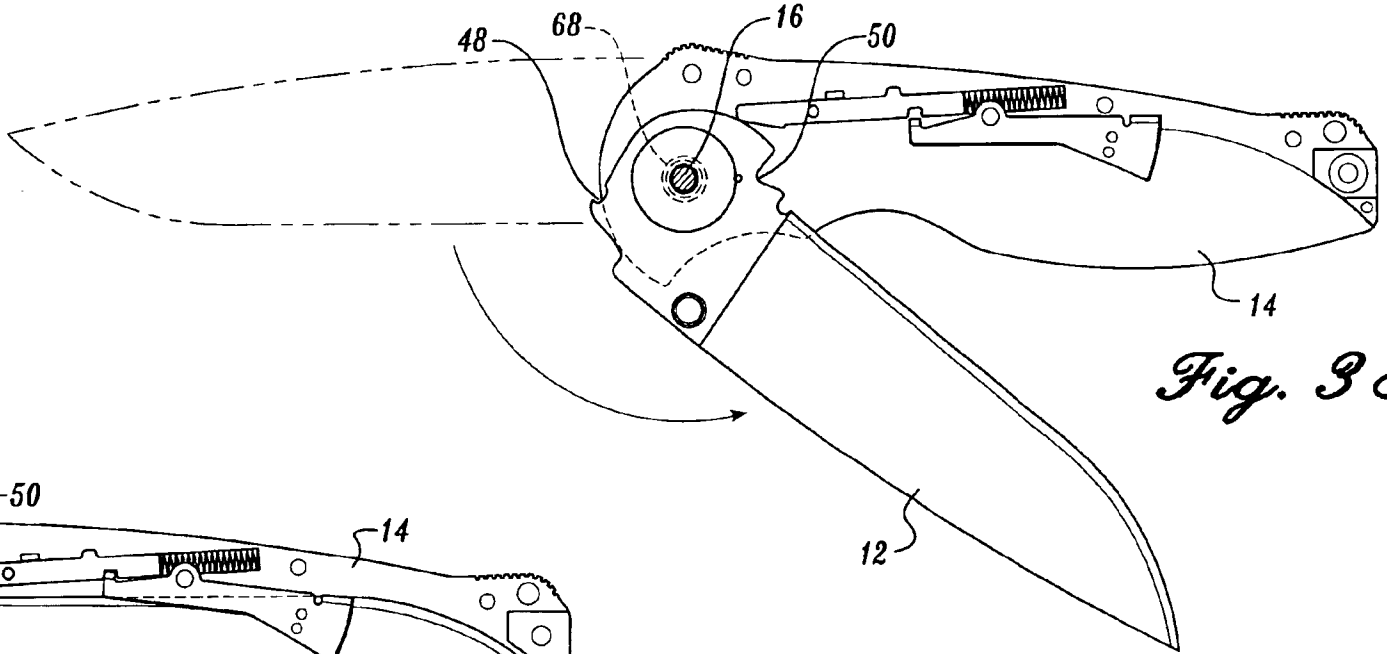
FIG. 38 is a side elevation corresponding to FIG. 37 but with the blade moved toward the closed position.

A safety mechanism is provided to selectively lock the plunger in the extended position, thereby preventing unlocking of the blade. When the safety is released, retraction of the plunger is permitted for unlocking the blade and moving it to the closed position. In this embodiment, the safety mechanism includes a swinging lever 190, most of which is received in a cavity 192 of one of the handles. The lever swings on a pivot 194. At the trailing end of the lever, a tab 196 projects outward through a slot 198 of the handle (FIG. 36). At the leading end, a tab 200 projects inward, beneath the plunger 182. Tab 200 is in position to register with a notch 202 of the plunger when the plunger is in the extended position, such as when its nose 180 is engaged in the locking notch 48 of the blade. Preferably a detent mechanism is provided, similar to that described with reference to FIG. 30, to retain the safety lever in its "safety on" or "safety off" position.

Figure 39:
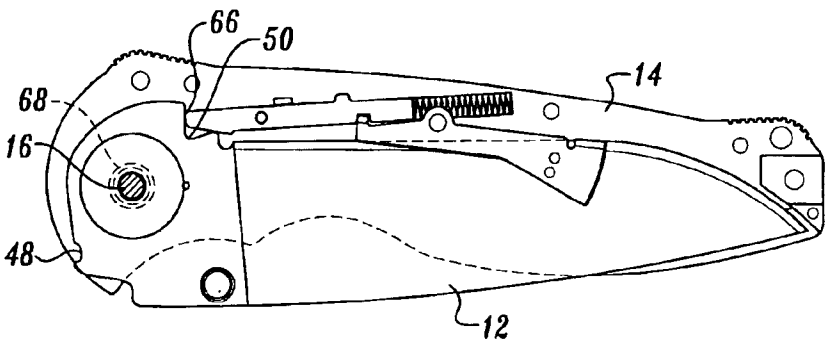
FIG. 39 is a side elevation corresponding to FIGS. 37 and 38 but with the blade in the closed position.

With the safety off, the plunger can be retracted by operation of the button 186 as described above, whereupon the knife blade 12 can be moved toward the closed position, against the biasing force of the opening spring 68. The nose of the plunger rides along the smooth portion of the blade tang 40 as the blade is pivoted to the closed position. When the blade reaches the closed position, or close to it, the plunger fits in the contoured recess 50 and acts against the abrupt side 66 of the recess, as seen in FIG. 39. In this position, the plunger applies a stronger closing force on the blade, sufficient to overcome the force of the opening spring. In addition, the plunger is extended in this position, such that the safety may be actuated to prevent retraction of the plunger. This prevents movement of the blade toward the open position unless the safety is released.

In the opposite direction, the safety is released to permit retraction of the plunger by opening of the blade. When the blade is in or near its closed position, the force of the plunger against the abrupt side 66 of the contoured notch 50 is sufficient to overcome the force of the opening spring 68. Consequently, the blade is biased closed. When the blade is moved through a predetermined angle, the plunger clears the notch and the opening spring will cause the blade to swing to its open position.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A folding knife comprising:

an elongated handle having a front end portion and a rear end portion;

a blade having a sharpened edge and a tang, the tang being pivotally attached to the front end portion of the handle for swinging of the blade between an open position in which the blade extends from the handle with the sharpened edge exposed for use and a closed position in which the sharpened edge is received by the handle;

a first blade-biasing component interconnected between the blade and the handle and providing a force tending to swing the blade from the closed position toward the open position when the blade is in the closed position; and a second blade-biasing component interconnected between the blade and the handle and providing a force opposing the force of the first blade-biasing component when the blade is in the closed position, the first and second blade-biasing components being constructed and arranged relatively such that the force of the first blade-biasing component is insufficient to swing the blade when the blade is in the closed position, the blade being moveable manually from the closed position toward the open position in the direction of the force applied by the first blade-biasing component and contrary to the force applied by the second blade-biasing component, and the first and second blade-biasing components being constructed and arranged relatively such that when the blade is moved manually through a predetermined angle from the closed position toward the open position the force applied by the first blade-biasing component is greater than the force applied by the second blade-biasing component and sufficient to automatically swing the blade farther toward the open position.

2. The knife defined in claim 1, in which the first blade-biasing component includes a first spring assembly for biasing the blade from the closed position toward the open position when the blade is in the closed position, the second blade-biasing component including a second spring assembly applying a force opposing the force of the first spring assembly when the blade is in the closed position.

3. The knife defined in claim 2, in which the blade is in an equilibrium position when moved through the predetermined angle from the closed position toward the open position with the force applied by the first blade-biasing component approximately equal to the force applied by the second blade-biasing component.

4. The knife defined in claim 2, in which the second spring assembly includes a mechanical member having a portion engaged against the tang of the blade, a second spring biasing the mechanical member against the tang of the blade, the tang being contoured to permit manual movement of the blade from the closed position toward the open position contrary to the force applied by the mechanical member and second spring, the tang contour being constructed and arranged relatively to result in a lesser biasing force being applied by the mechanical member and the second spring when the blade is moved through the predetermined angle from the closed position toward the open position than when the blade is in the closed position.

5. The knife defined in claim 4, in which the mechanical member includes a lever pivotally connected to the handle and having a swinging end portion engaged against the tang of the blade.

6. The knife defined in claim 5, in which the lever extends generally lengthwise of the handle.

7. The knife defined in claim 5, in which the lever extends transversely of the length of the handle.

8. The knife defined in claim 4, in which the mechanical member includes a plunger having an end portion biased against the tang of the blade.

9. The knife defined in claim 4, including a manually operable safety moveable between a locked position blocking movement of the mechanical member when the blade is in the closed position and an unlocked position permitting movement of the mechanical member to permit manual movement of the blade contrary to the force applied by the second blade-biasing component and in the same direction as the force applied by the first blade-biasing component.

10. The knife defined in claim 1, in which the second blade-biasing component includes a locking lever extending lengthwise of the handle and pivoted thereto, the locking lever having a central opening along a front portion thereof disposed toward the front of the handle, the tang of the blade having a projecting portion extending through the central opening of the locking lever when the blade is in the closed position, and a spring biasing the locking lever such that a front end portion thereof engages against the tang of the blade to apply a force opposing the force of the first blade-biasing component when the blade is in the closed position.

11. The knife defined in claim 10, in which the tang is contoured such that the blade is in an equilibrium position when moved through the predetermined angle from the closed position toward the open position such that in a position of less than the predetermined angle the force applied by the second blade-biasing component exceeds the force applied by the first blade-biasing component and at an angle greater than the predetermined angle the force applied by the first blade-biasing component exceeds the force applied by the second blade-biasing component.

12. The knife defined in claim 1, in which the biasing force applied by the first blade-biasing component is approximately constant through the range of motion of the blade relative to the handle.

13. The knife defined in claim 1, in which the predetermined angle is between 15 and 30 degrees.

* * * * *